US010424453B2

(12) United States Patent
Yang et al.

(10) Patent No.: US 10,424,453 B2
(45) Date of Patent: Sep. 24, 2019

(54) CIRCUIT BREAKER HAVING CIRCUIT OPERATING DEVICE

(71) Applicant: LSIS CO., LTD., Anyang-si, Gyeonggi-do (KR)

(72) Inventors: Seungpil Yang, Anyang-si (KR); Sangchul Lee, Anyang-si (KR); Youngkook Kim, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/900,331

(22) Filed: Feb. 20, 2018

(65) Prior Publication Data

US 2018/0240634 A1 Aug. 23, 2018

(30) Foreign Application Priority Data

Feb. 21, 2017 (KR) ..... 10-2017-0023132

(51) Int. Cl.
*H01H 71/10* (2006.01)
*H01H 71/12* (2006.01)
(Continued)

(52) U.S. Cl.
CPC ..... *H01H 71/10* (2013.01); *H01H 19/14* (2013.01); *H01H 71/0207* (2013.01);
(Continued)

(58) Field of Classification Search
CPC .... H01H 71/10; H01H 71/0207; H01H 71/04; H01H 71/08; H01H 71/128;
(Continued)

(56) References Cited

U.S. PATENT DOCUMENTS 6,437,262 B1 8/2002 Gupta et al.
7,439,835 B2 10/2008 Dietrich et al.
(Continued)

FOREIGN PATENT DOCUMENTS

CN 1574152 A 2/2005
CN 103703532 A 4/2014
(Continued)

OTHER PUBLICATIONS

European Search Report for related European Application No. 18155763.8; action dated Jul. 19, 2018; (6 pages).
(Continued)

*Primary Examiner* — Anthony R Jimenez
(74) *Attorney, Agent, or Firm* — K&L Gates LLP

(57) ABSTRACT

A circuit breaker having a circuit operating device according to one embodiment of the present invention includes a circuit unit having a main circuit, a detecting unit having a detection circuit for detecting a fault current in the main circuit, and a circuit operating device configured to allow connection or isolation between the main circuit and the detection circuit, wherein the circuit operating device includes a first fixed unit and a second fixed unit connected to the main circuit and the detection circuit, respectively, and arranged in parallel to each other, and a moving unit rotatably coupled between the first fixed unit and the second fixed unit to connect or isolate the main circuit and the detection circuit to or from each other.

12 Claims, 7 Drawing Sheets

(51) Int. Cl.

| | |
|---|---|
| ***H01H 19/14*** | (2006.01) |
| ***H01H 71/02*** | (2006.01) |
| ***H01H 71/04*** | (2006.01) |
| ***H01H 71/08*** | (2006.01) |
| ***H01H 1/42*** | (2006.01) |
| ***H01H 21/04*** | (2006.01) |
| ***H01H 21/50*** | (2006.01) |
| ***H01H 21/54*** | (2006.01) |

(52) U.S. Cl.
CPC ..... *H01H 71/04* (2013.01); *H01H 71/08* (2013.01); *H01H 71/128* (2013.01); *H01H 1/42* (2013.01); *H01H 21/04* (2013.01); *H01H 21/50* (2013.01); *H01H 21/54* (2013.01); *H01H 71/123* (2013.01); *H01H 2071/0292* (2013.01); *H01H 2071/046* (2013.01)

(58) Field of Classification Search
CPC ..... H01H 71/123; H01H 19/14; H01H 1/42; H01H 21/04; H01H 21/50; H01H 2071/0292; H01H 2071/046
USPC ..... 200/336
See application file for complete search history.

(56) References Cited

U.S. PATENT DOCUMENTS

| | | | | |
|---|---|---|---|---|
| 8,981,244 | B2 | 3/2015 | Ho et al. | |
| 9,810,719 | B2 * | 11/2017 | Youn | H01H 83/02 |
| 2015/0377930 | A1 | 12/2015 | Youn | |
| 2016/0301205 | A1 | 10/2016 | Lee | |

FOREIGN PATENT DOCUMENTS

| | | | | |
|---|---|---|---|---|
| EP | 03145440 | A1 | 5/1989 | |
| EP | 0314540 | B1 * | 9/1993 | H01H 1/205 |
| EP | 2028678 | A1 | 2/2009 | |
| EP | 3249671 | A2 * | 11/2017 | H01H 71/0264 |
| JP | 2003308764 | A | 10/2003 | |
| JP | 2008177098 | A | 7/2008 | |
| JP | 2008310988 | A | 12/2008 | |
| JP | 2009021249 | A | 1/2009 | |
| KR | 1020010099395 | A | 11/2001 | |
| KR | 20040100863 | A | 12/2004 | |
| KR | 2020120001883 | U | 3/2012 | |
| KR | 20170008506 | A | 1/2017 | |

OTHER PUBLICATIONS

Korean Office Action for related Korean Application No. 10-2017-0023132; action dated Feb. 23, 2018; (5 pages).
Chinese Office Action for related Chinese Application No. 201810129175.0; action dated Jan. 24, 2019; (12 pages).
Japanese Notice of Allowance for related Japanese Application No. 2018-028620; action dated Feb. 1, 2019; (3 pages).

* cited by examiner

CIRCUIT BREAKER HAVING CIRCUIT OPERATING DEVICE

CROSS-REFERENCE TO RELATED APPLICATION

Pursuant to 35 U.S.C. § 119(a), this application claims the benefit of earlier filing date and right of priority to Korean Patent Application No. 10-2017-0023132, filed on Feb. 21, 2017, the disclosure of which is hereby incorporated by reference in its entirety.

BACKGROUND OF THE INVENTION

1. Field of the Invention

The present invention relates to a circuit breaker, and more particularly, to a circuit breaker having a circuit operating device for maintenance.

2. Description of the Related Art

Generally, a circuit breaker is installed between a power source and a load to open and close a circuit. That is, the circuit breaker detects a fault current in the circuit and blocks the circuit, thereby protecting facilities and human lives. Such circuit breaker may include a main circuit and a detection circuit. The main circuit is provided for substantially opening and closing the circuit, and the detection circuit is provided for determining a status of the circuit. Here, the main circuit may break the circuit, in response to the detection circuit detecting the fault current.

However, the related art circuit breaker is implemented in a structure in which isolation between the main circuit and the detection circuit is impossible. This causes difficulty in inspection for maintenance. Therefore, a configuration is required for isolating the main circuit and the detection circuit from each other in the circuit breaker.

SUMMARY OF THE INVENTION

The present invention is devised to solve the aforementioned problem, and an aspect of the present invention is to provide a circuit breaker having a circuit operating device, capable of isolating a main circuit and a detection circuit from each other for maintenance of the circuit breaker.

A circuit breaker having a circuit operating device according to one embodiment of the present invention includes a circuit unit having a main circuit, a detecting unit having a detection circuit for detecting a fault current in the main circuit, and a circuit operating device configured to allow connection or isolation between the main circuit and the detection circuit, wherein the circuit operating device may include a first fixed unit and a second fixed unit connected to the main circuit and the detection circuit, respectively, and arranged in parallel to each other, and a moving unit rotatably coupled between the first fixed unit and the second fixed unit to connect or isolate the main circuit and the detection circuit to or from each other.

Here, the first fixed unit may be provided with a first fixed terminal connected to one of the main circuit and the detection circuit. The second fixed unit may be connected to the other one of the main circuit and the detection circuit and may be provided with a second fixed terminal facing the first fixed terminal.

The moving unit may include a rotating unit rotatably disposed between the first fixed unit and the second fixed unit, and a movable terminal disposed through the rotating unit, to be brought into contact with the first fixed terminal and the second fixed terminal or to be separated from the first fixed terminal and the second fixed terminal according to the rotation of the rotating unit.

Each of the first fixed terminal and the second fixed terminal may include contact portions brought into contact with both side surfaces of the movable terminal and having curved surfaces, respectively, to face the movable terminal, and a connection portion connecting the contact portions and supporting the contact portions.

The contact portions may be provided as a pair disposed with a predetermined interval therebetween, and the movable terminal may be inserted between the pair of contact portions.

The rotating unit may be provided with an accommodating portion in a shape of a circular pipe or a cylinder, and the circuit breaker may further include a spring inserted into the accommodating portion, and at least one ball disposed on at least one end of the spring in a manner of facing at least one of the first fixed unit and the second fixed unit.

At least one of the first fixed unit and the second fixed unit may further include a ball guide portion having a curved shape to guide the ball in a rotating direction of the rotating unit and control pressure applied to the spring by the ball.

The ball guide portion may be provided with a concave portion providing a space in which the ball is stopped.

The rotating unit may include a terminal hole into which the movable terminal is inserted, and a protruding portion protruding from an inner wall of the terminal hole to face the movable terminal, and the movable terminal may be provided with an inserting portion into which the protruding portion is inserted.

The rotating unit may be configured in a manner that a diameter of a first rotating unit formed on one portion thereof is larger than a diameter of a second rotating unit formed on another end portion thereof, and a first outer wall and a second outer wall formed on circumferences of the first rotating unit and the second rotating unit support the first fixed portion and the second fixed portion, respectively. Here, the second outer wall may be exposed to outside of the circuit breaker.

The second outer wall may be provided with a display portion configured to output a connected state or an isolated state between the main circuit and the detection circuit.

The moving unit may further include a handle disposed on the second outer wall.

Each of the first fixed unit and the second fixed unit may be provided with a handle guide portion disposed on one side thereof to expose the handle and a part of the display portion and provide a movable region of the handle.

In a circuit breaker having circuit operating device according to each embodiment of the present invention, the provided circuit operating device can allow isolation between the main circuit and the detection circuit. This may facilitate maintenance of the circuit breaker. Further, a handle and a display portion of the circuit operating device can be exposed to a front surface of the circuit breaker, which may facilitate visual check of a connected state or an isolated state between the main circuit and the detection circuit.

DETAILED DESCRIPTION OF THE INVENTION

Figure 1A:
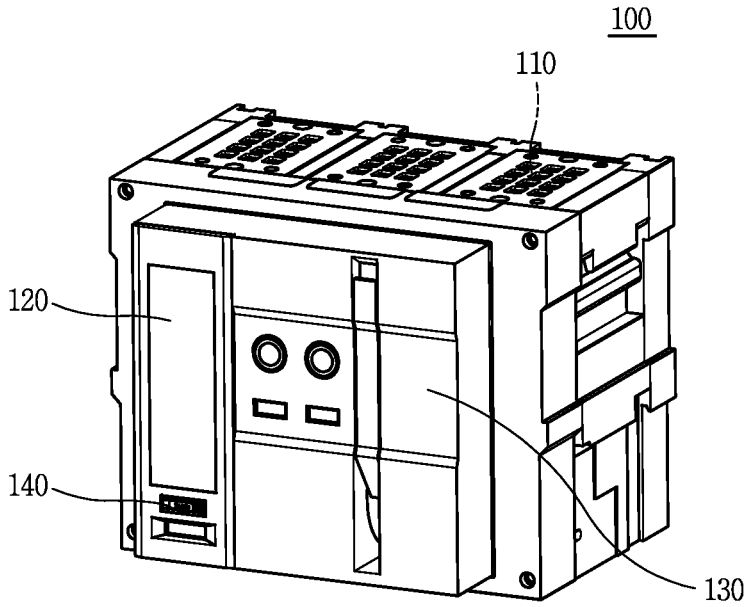
FIGS. 1A and 1B are a perspective view and a front view of a circuit breaker in accordance with one embodiment of the present invention.

Hereinafter, various embodiments of the present invention will be described with reference to the accompanying drawings. However, it should be understood that the technology described in this invention is not limited to particular embodiments, but should be understood as including various modifications, equivalents, and/or alternatives. In description of the drawings, the same/like reference numerals may be used for the same/like elements.

As used herein, the term "first," "second" or the like may be used to denote various components, regardless of order and/or importance, and may be used to distinguish one component from another without limiting the corresponding component.

Figure 1B:
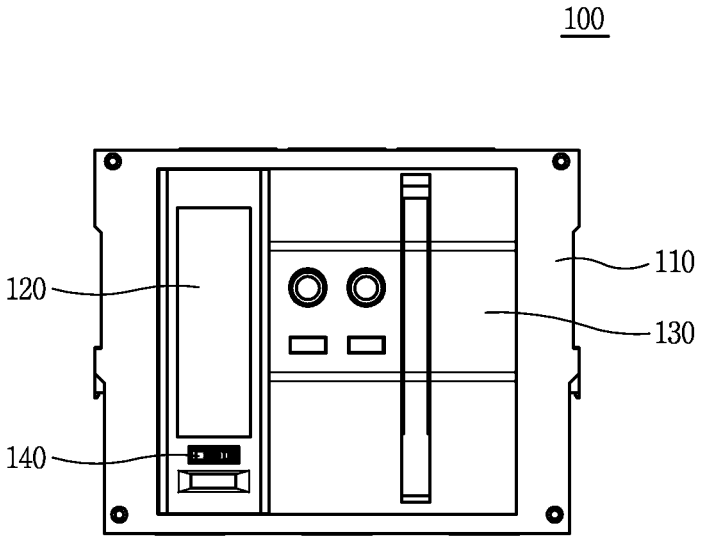
Figure 2A:
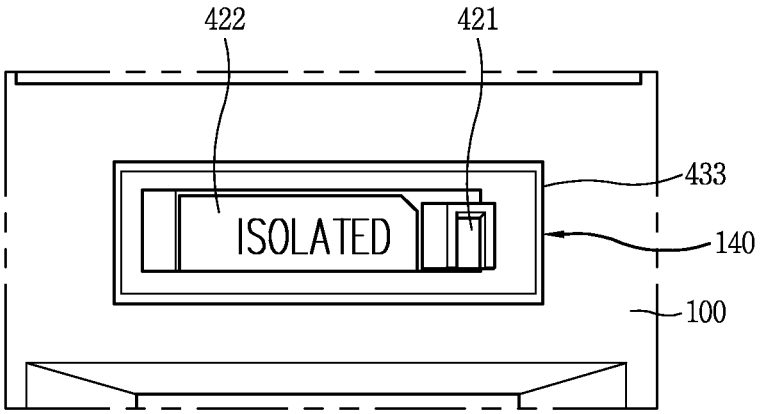
FIGS. 2A and 2B are detailed views of an operating device part of FIG. 1, which illustrates a change of a display portion according to a manipulation of a handle.
Figure 2B:
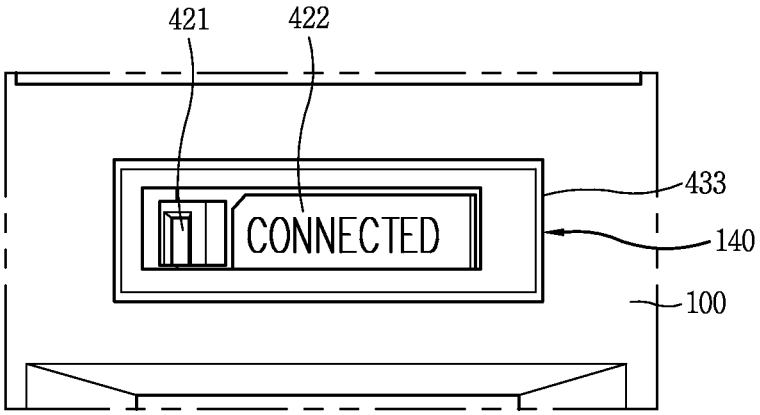

FIGS. 1A and 1B are a perspective view and a front view of a circuit breaker 100 in accordance with one embodiment of the present invention. FIGS. 2A and 2B are detailed views of an operating device part of FIG. 1, which illustrates a change of a display portion according to a manipulation of a handle.

A circuit breaker having a circuit operating device according to one embodiment of the present invention includes a circuit unit 110 having a main circuit, a detecting unit 120 having a detection circuit for detecting a fault current in the main circuit, and a circuit operating device 400 for allowing connection or isolation between the main circuit and the detection circuit. The circuit operating device 400 includes a first fixed unit 400 and a second fixed unit 450 connected to the main circuit and the detection circuit, respectively, and arranged in parallel to each other, and a moving unit 410 rotatably coupled between the first fixed unit 430 and the second fixed unit 450 to connect or isolate the main circuit and the detection circuit. This will be described in detail for each configuration.

The circuit breaker 100 according to one embodiment of the present invention includes a circuit unit 110, a detecting unit 120, an opening/closing unit 130, and an operating unit 140.

The circuit unit 110 is provided to supply currents to a circuit between a power source and a load. The circuit between the power source and the load and/or a circuit connected to the power source or the load in the circuit unit 110 is referred to as a main circuit. The circuit unit 110 includes a fixed contactor, a movable contactor, and an arc-extinguishing portion. The fixed contactor includes fixed contacts, and the respective fixed contacts are connected to the circuit. The movable contactor includes a movable contact. At this time, when the fixed contacts and the movable contact come into contact with each other, currents are supplied. On the other hand, when the fixed contacts and the movable contact are separated from each other, currents are cut off. The arc-extinguishing portion extinguishes an arc caused due to the contact and separation between the fixed contacts and the movable contact.

The detecting unit 120 recognizes (detect) a state of the circuit between the power source and the load, that is, the state of the main circuit. At this time, the detecting unit 120 may detect whether or not a fault current is generated in the main circuit. Here, the detecting unit 120 may detect, for example, an overcurrent, a short-circuit current, or the like as the fault current.

The opening/closing unit 130 controls the circuit unit 110. At this time, the opening/closing unit 130 controls the movable contactor according to the state of the circuit. The opening/closing unit 130 may control the movable contactor to be brought into contact with or separated from the fixed contacts. Here, the opening/closing unit 130 may separate the movable contact from the fixed contacts when the fault current is generated.

The operating unit 140 is provided for maintenance of the circuit breaker 100. The operating unit 140 may refer to an operating device 400 to be described later or a part of the operating device 400. The operating unit 140 may be configured such that the circuit unit 110 and the detecting unit 120 or the detecting unit 120 and the opening/closing unit 130 can be connected to each other or isolated from each other by a user's operation. That is, upon the maintenance of the circuit breaker 100, the operating unit 140 may isolate the circuit unit 110 and the detecting unit 120 from each other. Therefore, the main circuit and the detection circuit are separated from each other. When the maintenance of the circuit breaker 100 is completed, the operating unit 140 may connect the circuit unit 110 and the detecting unit 120 to each other. In this case, the main circuit and the detection circuit are connected to each other.

The operating unit 140 may be operated as illustrated in FIGS. 2A and 2B. Here, as illustrated in FIG. 2A, when a handle 421 is turned to one side, the operating unit 140 may isolate the circuit unit 110 and the detecting unit 120 from each other (As described above, in the present invention, the connection or isolation between the circuit unit and the detecting unit may be used as the same meaning as a connection or isolation between the main circuit and the detection circuit). At this time, a display portion 422 displays the isolated state. On the other hand, as illustrated in FIG. 2B, when the handle 421 is turned to another side, the operating unit 140 may connect the circuit unit 110 and the detecting unit 120 to each other. At this time, the display portion 422 displays the connected state.

Figure 3:
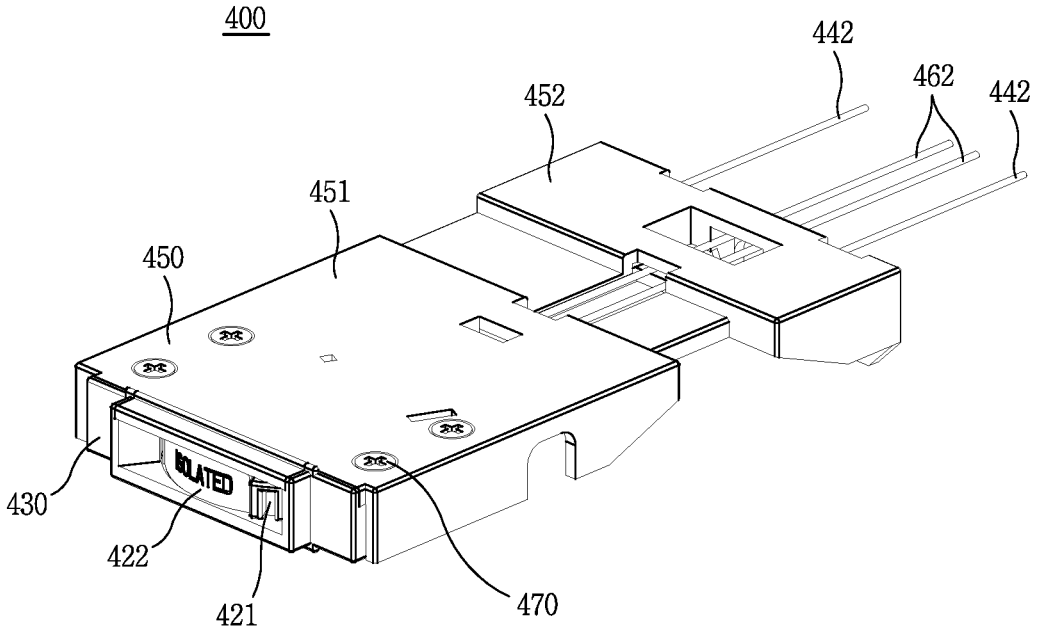
FIG. 3 is a perspective view of a circuit operating device in accordance with one embodiment of the present invention.
Figure 4:
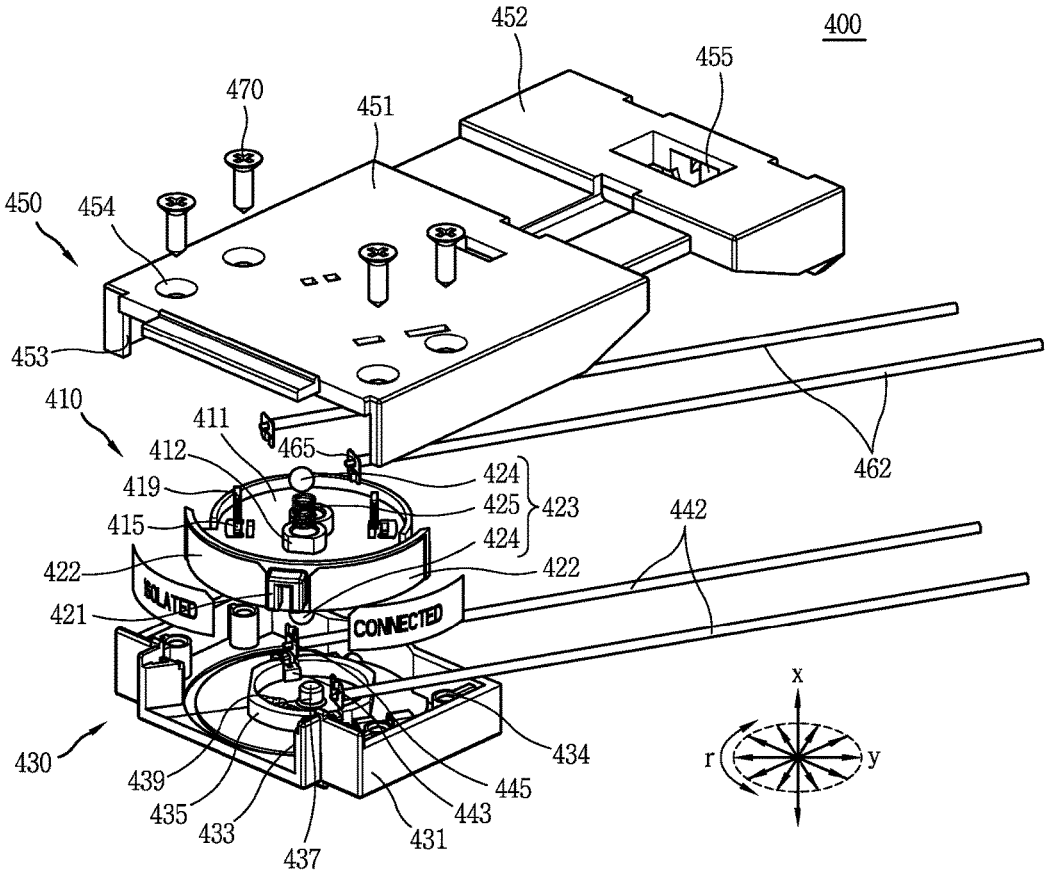
FIG. 4 is an exploded perspective view of FIG. 3.
Figure 5:
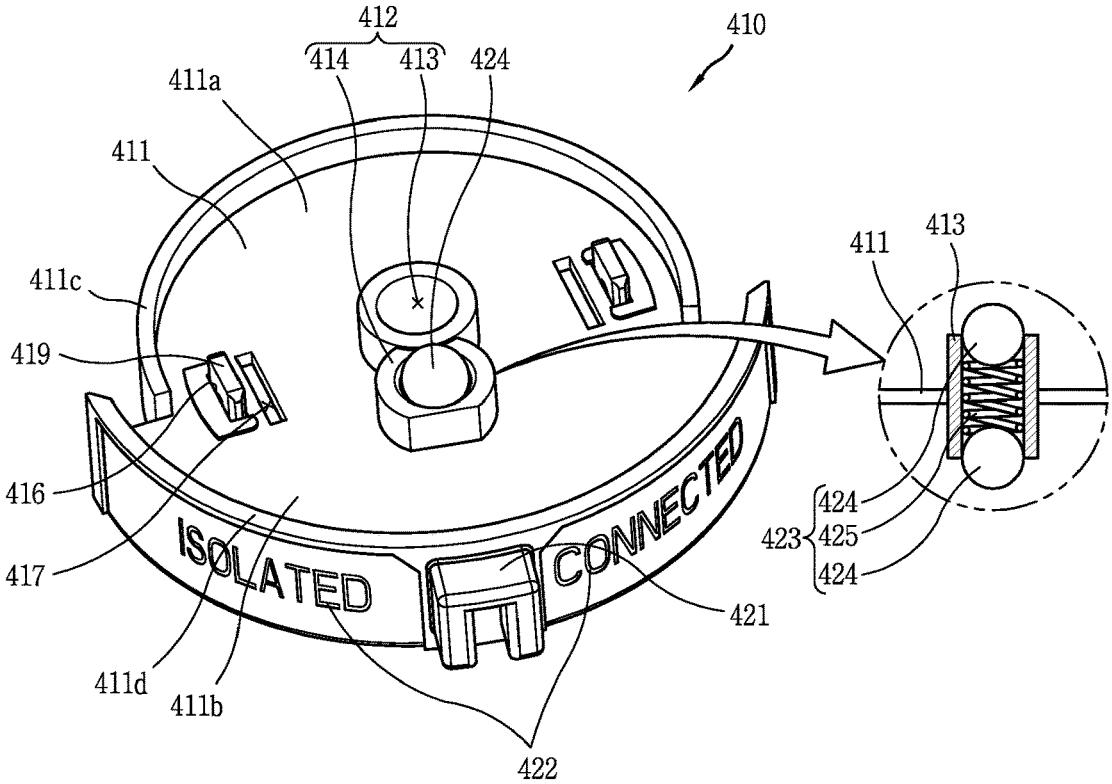
FIG. 5 is a perspective view illustrating a moving unit of FIG. 4.
Figure 6:
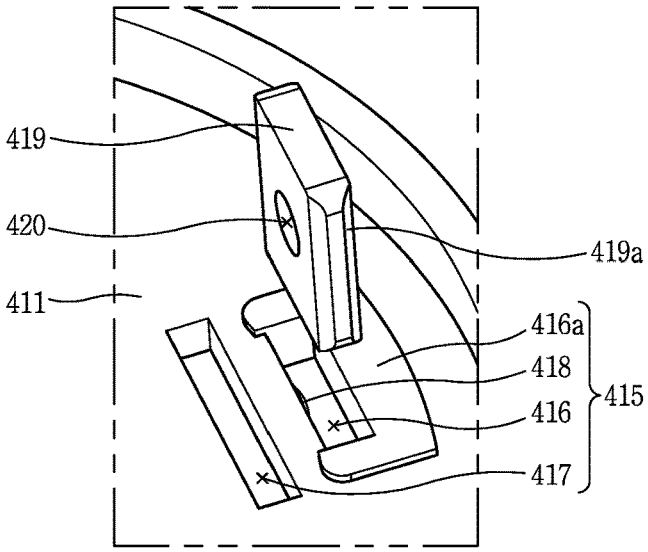
FIG. 6 is an enlarged view of a movable terminal portion and a movable terminal in FIG. 5.
Figure 7A:
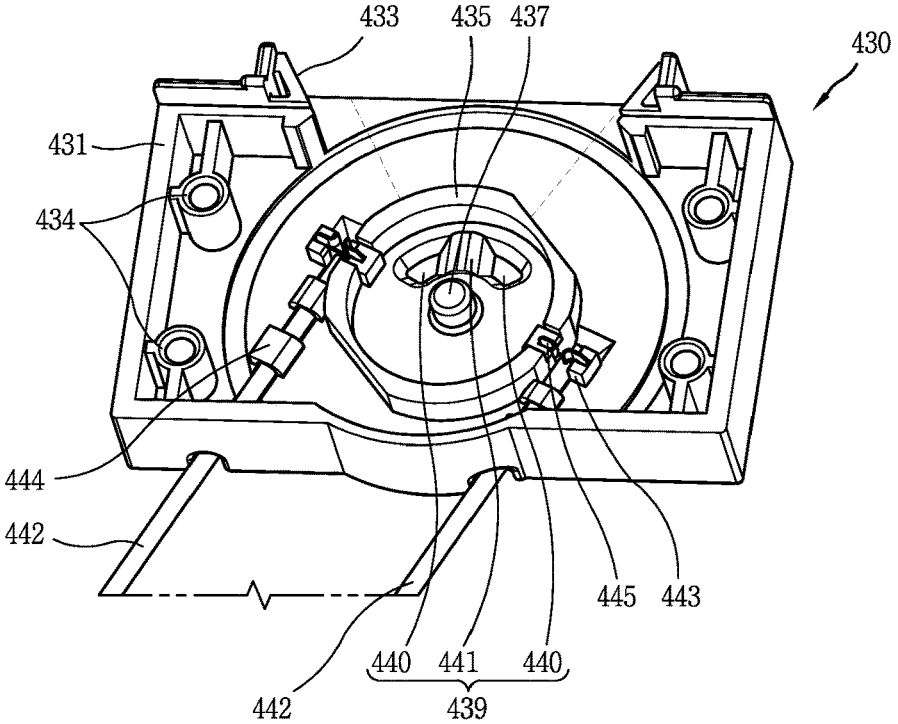
FIGS. 7A and 7B are a perspective view and a planar view of a first fixed unit in FIG. 4.
Figure 7B:
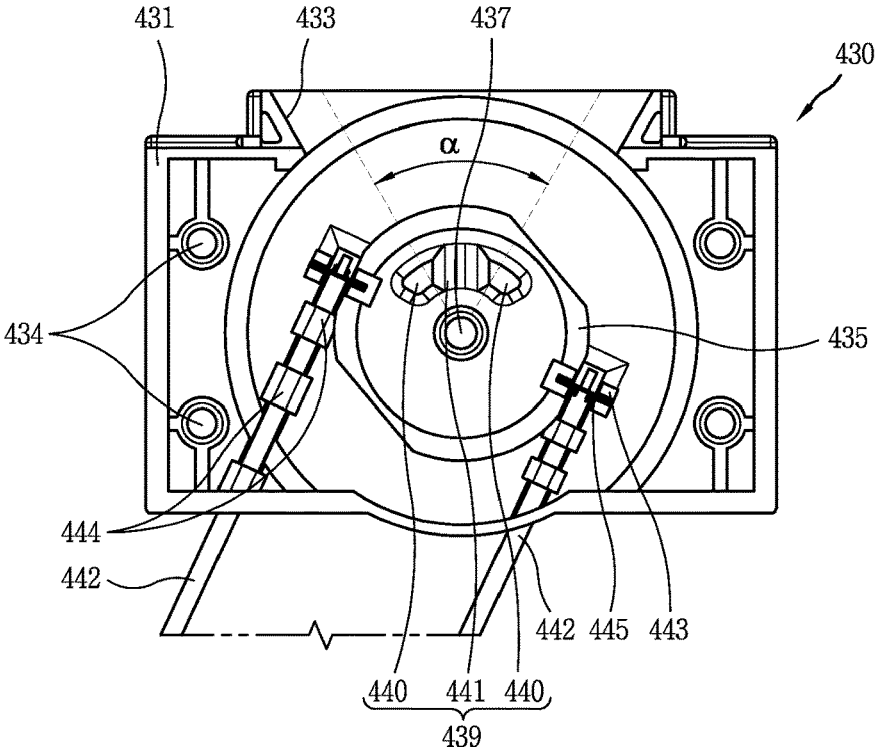
Figure 8:
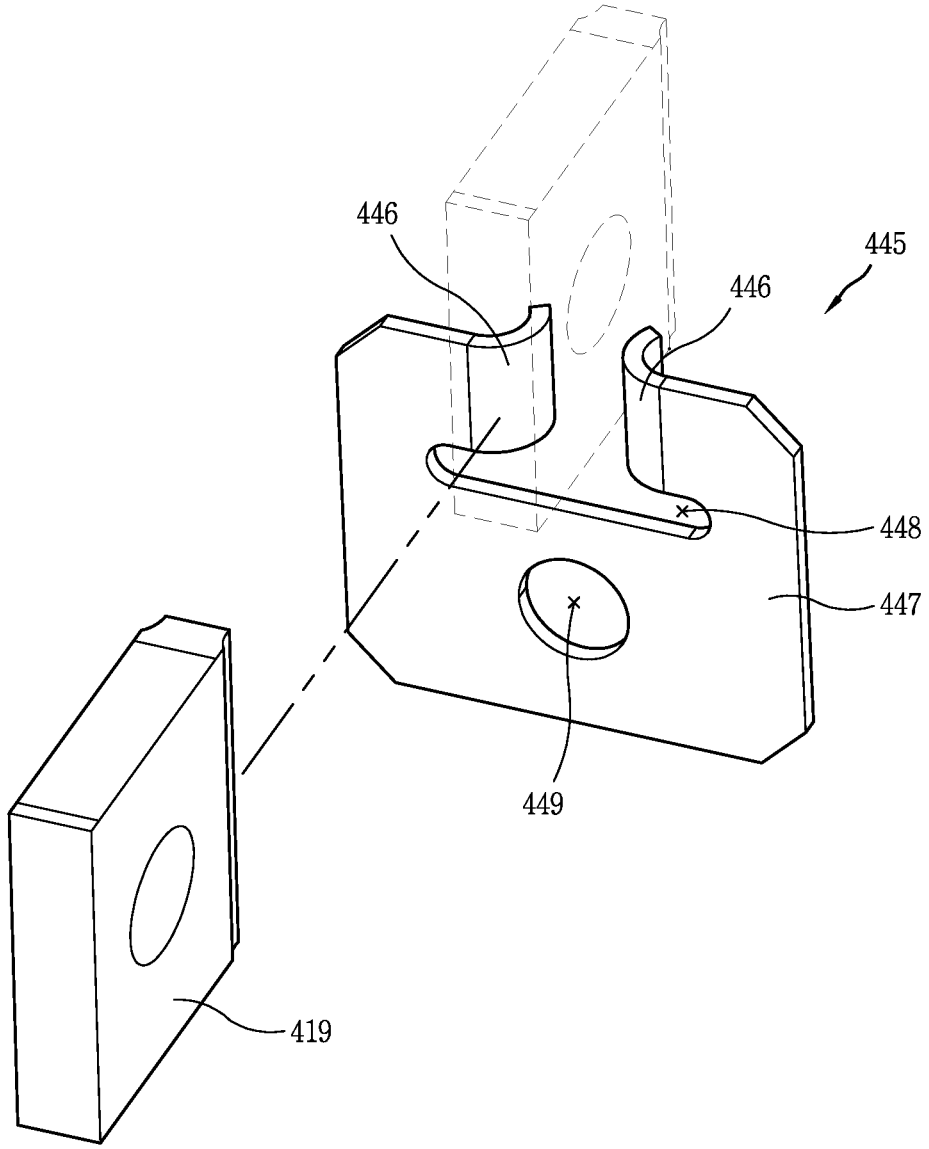
FIG. 8 is an enlarged view of a first fixed terminal in FIG. 7A.

FIGS. 3 and 4 are a perspective view and an exploded perspective view of a circuit operating device in accordance with one embodiment of the present invention. FIG. 5 is a perspective view of a moving unit in FIG. 4, and FIG. 6 is an enlarged view of a movable terminal portion and a movable terminal in FIG. 5. FIGS. 7A and 7B are a perspective view and a planar view of a first fixed unit in FIG. 4, and FIG. 8 is an enlarged view of a first fixed terminal in FIG. 7A.

The circuit operating device 400 includes a moving unit 410, a first fixed unit 430, a second fixed unit 450, and coupling members 470. At this time, an x-direction, a y-direction, and an r-direction may be defined (see FIG. 4). The x-direction (here, an x-axis is a line passing through a center of a first accommodating portion 413) may indicate a direction in which the moving unit 410, the first fixing portion 430 and the second fixing portion 450 are stacked.

The y-direction (a radial direction of the x-axis) is perpendicular to the x-direction and may indicate a direction extending from inside to outside of the first fixed unit 430 and the second fixed unit 450. The r-direction (a circumferential direction rotating centering on the x-axis) may correspond to a rotating direction of the moving unit 410. Here, the r-direction may include a clockwise direction and a counterclockwise direction.

The moving unit 410 is rotatably coupled between the first fixed unit 430 and the second fixed unit 450. At this time, the moving unit 410 may rotate along the r-direction. The moving unit 410 may include a rotating unit 411, movable terminals 419, a handle 421, and an elastic portion 423.

The rotating unit 411 is disposed in parallel between the first fixed unit 430 and the second fixed unit 450. The rotating unit 411 may be implemented as a rotary plate that is rotatably disposed between the first fixed unit 430 and the second fixed unit 450. At this time, the rotating unit 411 may support the movable terminals 419, the handle 421, and the elastic portion 423. The rotating unit 411 may maintain insulation between the moving unit 410 and the first fixed unit 430 and the second fixed unit 450. For this, a circumferential region of the rotating unit 411 may protrude to face the first fixed unit 430 and the second fixed unit 450. In addition, the rotating unit 411 may be made of an insulating material. The rotating unit 411 may include an accommodating portion 412 and a movable terminal portion 415.

The rotating unit 411 may be formed in a circular shape, i.e., a circular plate or a disc. A part of the rotating unit 411 may be formed larger in diameter than the other portion. For example, a diameter of one semicircular portion of the rotating unit 411 may be formed larger than a diameter of the other semicircular portion. Here, a portion with a small diameter is referred to as a first rotating unit 411*a*, and a portion with a large diameter is referred to as a second rotating unit 411*b*. A first outer wall 411*c* protrudes from a circumference of the first rotating unit 411*a* and a second outer wall 411*d* protrudes from a circumference of the second rotating unit 411*b*.

The display portion 422 is formed on an outer circumferential surface of the second outer wall 411*d*. The display portion 422 is exposed to a front surface of the circuit breaker 100. The display portion 422 is provided with a sign (mark, indicator) indicating the connected state or the isolated state. In this example, a sticker may be attached.

The accommodating portion 412 may be disposed at a central region of the rotating unit 411. At this time, the accommodating portion 412 may be formed through the rotating unit 411. Here, the accommodating portion 412 may penetrate through the rotating unit 411 in the x-direction. The accommodating portion 412 may be formed to have a predetermined depth (height). The accommodating portion 412 may be formed in a shape of a circular pipe or a cylinder. The accommodating portion 412 may include a first accommodating portion 413 and a second accommodating portion 414. The first accommodating portion 413 may be disposed at the center of the rotating unit 411 and the second accommodating portion 414 may be disposed adjacent to the first accommodating portion 413.

A movable terminal portion 415 may be disposed at an edge region of the rotating unit 411. The movable terminal portion 415 may be formed as a pair spaced apart from each other by a predetermined angle based on the accommodating portion 412. Each of the pair of movable terminal portions 415 may include a terminal hole 416, a terminal support portion 416*a*, an auxiliary hole 417, and a protruding portion 418. The terminal hole 416 and the auxiliary hole 417 may be formed through the rotating unit 411. Here, the terminal hole 416 and the auxiliary hole 417 may penetrate through the rotating unit 411 in the x-direction. The terminal hole 416 and the auxiliary hole 417 may be formed in a slit shape perpendicular to the y-direction. The terminal hole 416 and the auxiliary hole 417 may be disposed adjacent to each other. The protruding portion 418 may be disposed on an inner wall of the terminal hole 416 adjacent to the auxiliary hole 417 and protrude to inside of the terminal hole 416. Here, the protruding portion 418 may protrude in the y-direction perpendicular to the x-direction. The terminal support portion 416*a* protrudes around the terminal hole 416 to support the movable terminal 419.

The movable terminal 419 is formed of a conductive material in a plate shape. The movable terminal 419 may protrude from the rotating unit 411 to face the first fixed unit 430 and the second fixed unit 450. For this purpose, the movable terminal 419 may be coupled to the movable terminal portion 415 on the rotating unit 411. At this time, the movable terminal 419 may be inserted through the terminal hole 416. The movable terminal 419 is installed perpendicular to the y-direction. A thickness of the movable terminal 419 may become thinner toward an edge region thereof. For example, in the movable terminal 419, a thickness of a central region may be uniform and thicker than a thickness of the edge region. Further, in the movable terminal 419, the thickness of the edge region may become thinner toward the outside. That is, a chamfered portion 419*a* may be formed on the edge region of the movable terminal 419.

The movable terminal 419 includes an inserting portion 420. The inserting portion 420 may be disposed at the central region of the movable terminal 419. Further, the inserting portion 420 may be formed through the movable terminal 419. For example, the insertion portion 420 may be formed as a through hole. Here, the inserting portion 420 may penetrate through the movable terminal 419 in the y-direction. As a result, as the movable terminal 419 is inserted through the terminal hole 416, the protruding portion 418 may be inserted into the inserting portion 420. To this end, the auxiliary hole 417 may provide tension to the insertion portion 420 so that the protruding portion 418 can be inserted into the inserting portion 420. As the protruding portion 418 is inserted into the inserting portion 420, the movable terminal 419 is not separated from the terminal hole 416.

The handle 421 is provided for a user to rotate the moving unit 410. That is, the handle 421 may apply rotational force to the moving unit 410 by the user's operation. To this end, the handle 421 may be disposed at the circumferential region of the rotating unit 411, particularly, at the second outer wall 411*d*. The handle 421 may protrude toward the outside of the rotating unit 411. The handle 421 may be disposed at a central region of the display portion 422. Here, the sign indicating the connected state or the isolated state may be attached to a left or right region of the handle 421 on the display portion 422 in a distinguishable manner. A sticker 422 is provided to identify the rotating direction of the moving unit 410 and may be attached based on the handle 421.

The elastic portion 423 is provided for setting a stop position of the moving unit 410 and supporting the rotation of the moving unit 410. That is, the elastic portion 423 may work together with a ball guide portion 439 to be explained later to provide or restrict a movement or stop region of the moving unit 410 and apply elastic force with respect to the rotational force applied to the moving unit 410. For this, the elastic portion 423 may be disposed in one of the first and second accommodating portions 413 and 414. Here, the elastic portion 423 may be disposed in the second accommodating portion 414, for example.

The elastic portion 423 includes at least one ball 424 and a spring 425. The ball 424 may be disposed to face at least one of the first fixed unit 430 and the second fixed unit 450. At least a portion of each ball 424 may protrude from the second accommodating portion 414 to face the first fixed unit 430 or the second fixed unit 450. The spring 425 may be inserted into the second accommodating portion 414. At this time, as the moving unit 410 is coupled to the first fixed unit 430 and the second fixed unit 450, the spring 425 may be compressed. According to one embodiment, two balls 424 may be disposed to face the first fixed unit 430 and the second fixed unit 450, respectively. Here, the spring 425 may be inserted into the second accommodating portion 414 so as to be disposed between the balls 424. The spring 425 may be compressed between the balls 424 as the moving unit 410 is coupled to the first fixed unit 430 and the second fixed unit 450. According to another embodiment, one ball 424 may be disposed to face one of the first fixed unit 430 and the second fixed unit 450. Here, the spring 425 may be inserted in the second accommodating portion 414 to be disposed between the rotating unit 411 and the ball 424. At this time, one side of the second accommodating portion 414 may be closed. The spring 425 may be compressed between the rotating unit 411 and the ball 424 as the moving unit 410 is coupled to the first fixed unit 430 and the second fixed unit 450.

The first fixed unit 430 and the second fixed unit 450 is coupled to each other. At this time, the first fixed unit 430 and the second fixed unit 450 may be disposed in parallel along the x-direction and may be coupled to each other along the edge region. For example, the first fixed unit 430 and the second fixed unit 450 may be engaged with each other on the edge region. Alternatively, one of the first fixed unit 430 and the second fixed unit 450 may be coupled to inside of the other. For this purpose, the first fixed unit 430 and the second fixed unit 450 may protrude from their edge regions to face each other. That is, an outer wall or a side wall may be formed on the edge region of each of the first fixed unit 430 and the second fixed unit 450. Accordingly, the first fixed unit 430 and the second fixed unit 450 may form an inner space. At this time, the moving unit 410 may be accommodated and supported within the inner space between the first fixed unit 430 and the second fixed unit 450.

The first fixed unit 430 is disposed at an opposite side of the second fixed unit 450 with respect to the moving unit 410. At this time, the first fixed unit 430 may be disposed at one side of the moving unit 410 in the x-direction. For example, the first fixed unit 430 may be disposed below the moving unit 410, and the moving unit 410 may be disposed above the first fixed unit 430. The first fixed unit 430 may include a first case 431 and a first fixed terminal 445.

The first case 431 supports the moving unit 410 and the second fixed unit 450. The first case 431 may maintain insulation among the moving unit 410, the first fixed unit 430 and the third fixed unit 450. To this end, the first case 431 may be formed of an insulating material. The first case 431 may include a first handle guide portion 433, a coupling groove 434, a support portion 435, a pivot 437, a ball guide portion 439, a fixed terminal portion 443, and a wiring guide portion 444. According to one embodiment, when the ball 424 of the moving unit 410 faces the first fixed unit 430, the first case 431 may include the ball guide portion 439. According to another embodiment, when the ball 424 of the moving unit 410 does not face the first fixed unit 430, the first case 431 may not include the ball guide portion 439.

The first handle guide portion 433 is disposed on one side of the first case 431. The first handle guide portion 433 may be implemented as a pair of inclined walls which are symmetrical with each other at a predetermined angle with respect to the pivot 437. The first handle guide portion 433 externally exposes a part of the second outer wall 411*d* of the moving unit 410. Accordingly, the handle 421 and a part of the display portion 422 may be exposed to the outside of the first case 431. The first handle guide portion 433 may define a movable region of the handle 421. Here, the first handle guide portion 433 may provide the movable region of the handle 421 in the r-direction. Thus, the handle 421 may be movable between both of the inclined walls of the first handle guide portion 433. In this time, a rotation angle $\alpha$ of the moving unit 410 may be defined as an angle between straight lines extending from a rotational axis of the moving unit 410 to the center of the handle 421 contacting the both inclined walls of the first handle guide portion 433.

The coupling groove 434 is disposed on the edge region of the first case 431. At this time, the coupling groove 434 may be formed along the x-direction. The coupling grooves 434 may be realized with a predetermined depth.

The support portion 435 is disposed to face rotating unit 411 of the moving unit 410. The support portion 435 may support the rotating unit 411 of the moving unit 410. At this time, the support portion 435 may support the rotating unit 411 between the accommodating portion 412 and the movable terminal portion 415. Here, the support portion 435 may protrude in the x-direction. For example, the support portion 435 may be formed in a circular shape. Here, a diameter of the support portion 435 may be shorter than a diameter of the rotating unit 411 of the moving unit 410. Accordingly, the accommodating portion 412 of the moving unit 410 may be disposed inside the support portion 435 and the movable terminal portion 415 of the moving unit 410 may be disposed outside the support portion 435.

The pivot 437 is disposed at a central region of the support portion 435. At this time, the pivot 437 may protrude to face one of the first and second accommodating portions 413 and 414 (i.e., 412) of the moving unit 410. Here, the pivot 437 may protrude in the x-direction. The pivot 437 may have a predetermined height. Accordingly, the pivot 437 may be inserted into any one of the first and second accommodating portions 413 and 414 of the moving unit 410. Here, the pivot 437 may be inserted into the first accommodating portion 413 of the moving unit 410. The pivot 437 may thus be a rotational axis of the moving unit 410, so that the moving unit 410 can rotate centering on the pivot 437 in correspondence with the first fixed portion 430.

The ball guide portion 439 is disposed in an inner region of the support portion 435. At this time, the ball guide portion 439 may be disposed to face another one of the accommodating portions 412 of the moving unit 410. Here, the ball guide portion 439 may be arranged to face the second accommodating portion 414 of the moving unit 410. That is, the ball guide portion 439 may be disposed to face the elastic portion 423 of the moving unit 410. The ball guide portion 439 may provide or restrict a movable region of the ball 424. At this time, the ball guide portion 439 may provide the movable region of the ball 424 based on the rotation angle $\alpha$ of the moving unit 410. For this purpose, the ball guide portion 439 may be disposed between the first handle guide portion 433 and the pivot 437.

The ball guide portion 439 is formed in a curved shape so as to control pressure which is applied to the spring 425 by the elastic portion 423. The ball guide portion 439 may include two concave portions 440 and a convex portion 441. The concave portions 440 may be disposed in such a manner of being connected to each other. Here, the lowest points of the concave portions 440 may be disposed on straight lines extending from the pivot 437 to both ends of the first handle guide portion 433. Accordingly, a movement angle of the ball 424 may be realized to be the same as a movement angle of the handle 421. The convex portion 441 may be curved between the concave portions 440. Accordingly, the ball guide portion 439 may guide the movement of the ball 424 within the rotation angle of the moving unit 410. The ball 424 may be stopped in each concave portion 440, so as to maintain the connected state or the isolated state.

The fixed terminal portion 443 is disposed on an outer region (outer surface) of the support portion 435. The fixed terminal portion 443 may be formed as a pair spaced apart from each other by a predetermined angle based on the pivot 437. At this time, the fixed terminal portion 443 may be disposed to face the movable terminal portion 415 of the moving unit 410. Each of the fixed terminal portions 443 may be formed concavely. Here, each of the fixed terminal portions 443 may be recessed in the x-direction. Further, each of the fixed terminal portions 443 may have a predetermined depth.

The wiring guide portion 444 is disposed on an outer region of the support portion 435. At this time, the wiring guide portion 444 may be arranged on an extension path of the wiring, in a manner of being adjacent to the fixed terminal portion 443. The wiring guide portion 444 may fix the wiring. For example, the wiring guide portion 444 may be formed in an arcuate shape such that the wiring can be inserted therethrough.

A first wiring 442 is provided in the fixed terminal portion 443 and the wiring guide portion 444. The first wiring 442 is a line connected to one of the main circuit and the detection circuit.

The first fixed terminal 445 is disposed to face the movable terminal 419. At this time, the first fixed terminal 445 may be coupled to the fixed terminal portion 443. The first fixed terminal 445 may include contact portions 446 and a connection portion 447 (see FIG. 8).

The contact portions 446 may be exposed from the fixed terminal portion 443. At this time, the contact portions 446 may protrude to face the movable terminal 419. The contact portions 446 may be in contact with the movable terminal 419. Here, the contact portions 446 may be in contact with both sides of the movable terminal 419, respectively. Each of the contact portions 446 may have a curved surface facing the movable terminal 419. Here, the movable terminal 419 may be drawn in and out between the contact portions 446 while rotating along the r-direction. For example, the movable terminal 419 may be inserted between the contact portions 446 in a clockwise direction and drawn out between the contact portions 446 in a counterclockwise direction. At this time, each of the contact portions 446 may have a curved shape to facilitate the insertion of the movable terminal 419. A distance between the contact portions 446 may be smaller than a thickness of the movable terminal 419. Accordingly, the movable terminal 419 may receive contact pressure when the movable terminal 419 is interposed between the contact portions 446.

The connection portion 447 may connect the contact portions 446 to each other. The connection portion 447 may support the contact portions 446. For this, the connection portion 447 may be coupled to the fixed terminal portion 443. At this time, at least part of the connection portion 447 may be inserted into the fixed terminal portion 443. The connection portion 447 may be connected to the wiring. The connection portion 447 may include a tension hole 448 and a connection hole 449. The tension hole 448 may be formed through the connection portion 447 at a position adjacent to the contact portions 446. The tension hole 448 may extend at the connection portion 447 in the y-direction, and penetrate through the connection portion 447 in the r-direction. Here, an extended length of the tension hole 448 may exceed a gap between the contact portions 446. The tension hole 448 may apply tension to the contact portions 446 so that the movable terminal 419 can be inserted between the contact portions 446 or drawn out from between the contact portions 446. The connection hole 449 may be provided for connection with the wiring. That is, the first wiring 442 may be inserted through the wiring guide portion 444 so as to be coupled to the connection hole 449.

The second fixed unit 450 may be disposed at an opposite side to the first fixed unit 430 with respect to the moving unit 410. At this time, the second fixed unit 450 may be disposed at another side of the moving unit 410 in the x-direction. For example, the second fixed unit 450 may be disposed above the moving unit 410, and the moving unit 410 may be disposed below the second fixed unit 450. The second fixed unit 450 may include a second case 451 and second fixed terminals 465.

At this time, a part of the second fixed unit 450 may be implemented in a symmetrical structure with the first fixed unit 430 with respect to the moving unit 410. In this case, since the second fixed unit 450 is similar to the first fixed unit 430, detailed description thereof will be omitted. The second handle guide portion 453 of the second case 451 may be coupled to the first handle guide portion 433 of the first case 431 so as to define the movable region of the handle 421 together with the first handle guide portion 433. Coupling holes 454 of the second case 451 may be disposed on the same line extending from (to be aligned with) the coupling groove 434 of the first case 431 and may be formed along the x-direction.

And second wirings 462 are disposed in the second fixed unit 450. The second wirings 450 are connected to the second fixed terminals 465. The second wirings 462 are connected to a circuit, to which the first wirings 442 are not connected, of the main circuit or the detection circuit.

An extending portion 452 is formed at the rear of the second case 451. The extending portion 452 is provided with a guide and wiring hole 455 through which each of the wirings 442 and 462 can be guided.

The coupling members 470 couple the first fixed unit 430 and the second fixed unit 450 to each other. Here, the coupling members 470 may couple the first fixed unit 430 and the second fixed unit 450 to each other in the x-direction. At this time, each of the coupling members 470 may be inserted into the coupling groove 434 of the first case 431 and the coupling hole 454 of the second case 451. Here, the coupling member 470 may be inserted through the coupling hole 454 of the second case 451 to be coupled to the coupling groove 434 of the first case 431.

According to various embodiments, the handle 421 may move within the first handle guide portion 433 and the second handle guide portion 453, based on a user manipulation. Accordingly, rotational force may be applied to the moving unit 410 between the first fixed unit 430 and the second fixed unit 450. This may allow the ball 424 of the elastic portion 423 to move from one of the concave portions 440 to the other in the ball guide portion 439. At this time, as the ball 424 of the elastic portion 423 passes through the convex portion 441, elastic force may be applied by the spring 423 to the ball 424. That is, as the spring 425 is compressed by the ball 424, pushing force may be applied by the spring 425 to the ball 424. Accordingly, the moving unit 410 can rotate between the first fixed unit 430 and the second fixed unit 450 based on the rotational force and the elastic force.

According to various embodiments, as the moving unit 410 rotates between the first fixed portion 430 and the second fixed portion 450, the movable terminal 419 may move between the contact portions 446. That is, the movable terminal 419 may be inserted between the contact portions 446, or drawn out from between the contact portions 446. At this time, as the movable terminal 419 is inserted between the contact portions 446, the movable terminal 419 may come into contact with the contact portions 446. This may allow the movable terminal 419 to be brought into contact with the first fixed terminal 445 and the second fixed terminal 465, so that currents can be supplied to the wirings 442 and 462. On the other hand, as the movable terminal 419 is drawn out from between the contact portions 446, the movable terminal 419 may be separated from the contact portions 446. As a result, the movable terminal 419 can be separated from the first fixed terminal 445 and the second fixed terminal 465, to cut off the current supply to the wirings 442 and 462. For example, the first fixed terminal 445 may be connected to the detecting unit 120, and the second fixed terminal 465 may be connected to the circuit unit 110. Thus, the main circuit and the detection circuit may be connected to or isolated from each other.

This makes it easy to maintain the circuit breaker. Further, the handle and the display portion of the circuit operating device can be exposed to the front surface of the circuit breaker, which facilitates the manipulation and visual check of the connection or isolation between the main circuit or the detection circuit.

The terminology used herein is for the purpose of describing specific embodiments only and is not intended to limit the scope of the other embodiments. A singular representation may include a plural representation unless it represents a definitely different meaning from the context. Terms used herein, including technical or scientific terms, may have the same meaning as commonly understood by those skilled in the art to which the present invention pertains. Terms defined in the general dictionary of terms used herein may be construed as the same or similar meaning as that in the context of the related technology, and should not be construed too ideally or excessively, unless otherwise clearly defined in this document.

What is claimed is:

1. A circuit breaker having a circuit operating device, the circuit breaker comprising:

a circuit unit having a main circuit, wherein the main circuit includes a fixed contact and a movable contact;

a detecting unit having a detection circuit for detecting a fault current in the main circuit; and the circuit operating device allowing connection or isolation between the main circuit and the detection circuit, wherein the circuit operating device comprises:

a first fixed unit and a second fixed unit connected to the main circuit and the detection circuit, respectively, and arranged in parallel to each other; and a moving unit rotatably coupled between the first fixed unit and the second fixed unit to connect or isolate the main circuit and the detection circuit to or from each other, wherein the first fixed unit is provided with a first fixed terminal connected to one of the main circuit and the detection circuit, and wherein the second fixed unit is connected to the other one of the main circuit and the detection circuit and provided with a second fixed terminal facing the first fixed terminal.

2. The circuit breaker of claim 1, wherein the moving unit comprises:

a rotating unit rotatably disposed between the first fixed unit and the second fixed unit; and a movable terminal disposed through the rotating unit, to be brought into contact with the first fixed terminal and the second fixed terminal or to be separated from the first fixed terminal and the second fixed terminal according to the rotation of the rotating unit.

3. The circuit breaker of claim 2, wherein each of the first fixed terminal and the second fixed terminal comprises:

contact portions brought into contact with both side surfaces of the movable terminal and having curved surfaces, respectively, to face the movable terminal; and a connection portion connecting the contact portions and supporting the contact portions.

4. The circuit breaker of claim 3, wherein the contact portions are provided as a pair disposed with a predetermined interval therebetween, and the movable terminal is inserted between the pair of contact portions.

5. The circuit breaker of claim 2, wherein the rotating unit is provided with an accommodating portion in a shape of a circular pipe or a cylinder, wherein the circuit breaker further comprises:

a spring inserted into the accommodating portion; and at least one ball disposed on at least one end of the spring in a manner of facing at least one of the first fixed unit and the second fixed unit.

6. The circuit breaker of claim 5, wherein at least one of the first fixed unit and the second fixed unit further comprises:

a ball guide portion having a curved shape to guide the ball in a rotating direction of the rotating unit and control pressure applied to the spring by the ball.

7. The circuit breaker of claim 6, wherein the ball guide portion has a concave portion providing a space in which the ball is stopped.

8. The circuit breaker of claim 2, wherein the rotating unit comprises:

a terminal hole into which the movable terminal is inserted; and a protruding portion protruding from an inner wall of the terminal hole to face the movable terminal, and wherein the movable terminal has an inserting portion into which the protruding portion is inserted.

9. The circuit breaker of claim 2, wherein the rotating unit is configured in a manner that a diameter of a first rotating unit formed on one portion thereof is larger than a diameter of a second rotating unit formed on another end portion thereof, and a first outer wall and a second outer wall formed on circumferences of the first rotating unit and the second rotating unit support the first fixed portion and the second fixed portion, respectively, wherein the second outer wall is exposed to outside of the circuit breaker.

10. The circuit breaker of claim 9, wherein the second outer wall is provided with a display portion to output a connected state or an isolated state between the main circuit and the detection circuit.

11. The circuit breaker of claim 10, wherein the moving unit further comprises a handle disposed on the second outer wall.

12. The circuit breaker of claim 11, wherein each of the first fixed unit and the second fixed unit is provided with a handle guide portion provided at one side thereof to expose the handle and a part of the display portion and provide a movable region of the handle.

* * * * *